US009204734B2

(12) United States Patent
Jablonski et al.

(10) Patent No.: US 9,204,734 B2
(45) Date of Patent: Dec. 8, 2015

(54) CUP STORAGE SYSTEM

(71) Applicant: CORNELIUS, INC., St. Paul, MN (US)

(72) Inventors: Thaddeus Jablonski, Palatine, IL (US); David M. Joyce, Des Plaines, IL (US); James Kasallis, Lombard, IL (US); Dusan N. Ivancevic, Carol Stream, IL (US)

(73) Assignee: Cornelius, Inc., St. Paul, MN (US)

( * ) Notice: Subject to any disclaimer, the term of this patent is extended or adjusted under 35 U.S.C. 154(b) by 204 days.

(21) Appl. No.: 13/904,310

(22) Filed: May 29, 2013

(65) Prior Publication Data

US 2014/0353330 A1 Dec. 4, 2014

(51) Int. Cl.
*A47F 1/08* (2006.01)

(52) U.S. Cl.
CPC ..... *A47F 1/085* (2013.01)

(58) Field of Classification Search
CPC ..... A47F 1/085; A47F 1/123
See application file for complete search history.

(56) References Cited

U.S. PATENT DOCUMENTS

| | | | | | |
|---|---|---|---|---|---|
| 1,058,787 | A | * | 4/1913 | Nias | 221/308 |
| 1,689,393 | A | * | 10/1928 | Klein | 221/308 |
| 1,975,649 | A | * | 10/1934 | Reifsnyder | 221/308 |
| 3,265,243 | A | * | 8/1966 | Velter | 221/63 |
| 3,373,900 | A | * | 3/1968 | Staley | 221/199 |
| 4,989,753 | A | | 2/1991 | Brogna et al. | |
| 5,000,345 | A | | 3/1991 | Brogna et al. | |
| 5,941,415 | A | * | 8/1999 | Roethel | 221/310 |
| 6,053,359 | A | * | 4/2000 | Goulet et al. | 221/221 |
| 6,102,246 | A | | 8/2000 | Goulet et al. | |
| 7,325,701 | B1 | * | 2/2008 | Meyer et al. | 221/310 |
| 8,857,660 | B2 | * | 10/2014 | Omdoll et al. | 221/307 |
| 2011/0284572 | A1 | | 11/2011 | Meyer et al. | |

* cited by examiner

*Primary Examiner* — Timothy Waggoner
(74) *Attorney, Agent, or Firm* — Andrus Intellectual Property Law, LLP

(57) ABSTRACT

The cup storage device includes a tube having opposing dispensing and terminal ends and inner and outer surfaces that define an inner volume. The inner volume receives cups stacked upon each other and stores them. The cup storage device includes a plurality of resilient cup restraining members disposed on the inner surface of the tube at the dispensing end. The cup restraining members extend from a mounting end proximate the inner surface of the tube to a contact end. A guide structure is positioned on the inner surface of the tube. The guide structure defines a recess. The contact ends of the plurality of cup restraining members are disposed within the recess.

21 Claims, 5 Drawing Sheets

CUP STORAGE SYSTEM

FIELD OF THE INVENTION

The invention relates to cup storage systems, and more particularly to cup storage systems for beverage dispensing machines.

BACKGROUND OF THE INVENTION

Beverage dispensing systems and machines may include a cup storage area to provide cups for automated and manual applications. Typically, such cup storage systems include structures to accommodate a stack of cups. Generally, such cup storage systems are loaded from a top of the apparatus such that cups are stored in a vertical array. Current cup storage and retention devices are prone to damage when loading, cleaning, and adjusting cups within the apparatus. Further, top loading of the current cup storage apparatus may be difficult and require a ladder or other apparatus to reach a top of a storage apparatus.

There is therefore a need in the art for an improved cup storage device that allows bottom loading of cups within a cup storage device. There is also a need in the art for a cup storage device with improved retention structures that are not prone to damage during loading, cleaning, or adjusting of cups within the device. There is also a need in the art for an improved cup storage device that allows easy replacement of the components over a service life of the device.

SUMMARY OF THE INVENTION

In one aspect, there is disclosed a cup storage device for storing and dispensing a plurality of cups that includes a tube having opposing dispensing and terminal ends and inner and outer surfaces defining an open inner volume. A plurality of resilient cup restraining members is disposed on the inner surface of the tube at the dispensing end. The cup restraining members extend from a mounting end proximate the inner surface of the tube to a contact end. A guide structure is positioned on the inner surface of the tube. The guide structure defines a recess. The contact ends of the plurality of cup restraining members are disposed within the recess.

In another aspect, there is disclosed a cup storage device for storing and dispensing a plurality of cups that includes a tube having opposing dispensing and terminal ends and inner and outer surfaces defining an open inner volume. A cup dispensing structure is removably connected to the dispensing end of the tube. The cup dispensing structure includes a plurality of resilient cup restraining members disposed on the inner surface of the cup dispensing structure at the dispensing end. The cup restraining members extend from a mounting end proximate the inner surface of the cup dispensing structure to a contact end. A guide structure is positioned on the inner surface of the cup dispensing structure. The guide structure defines a recess. The contact ends of the plurality of cup restraining members are disposed within the recess.

In a further aspect, there is disclosed a cup storage device for storing and dispensing a plurality of cups that includes a tube having opposing dispensing and terminal ends and inner and outer surfaces defining an open inner volume. A plurality of resilient cup restraining members is disposed on the inner surface of the tube at the dispensing end. The cup restraining members extend from a mounting end proximate the inner surface of the tube to a contact end. A guide structure is positioned on the inner surface of the tube. The guide structure defines a recess. The contact ends of the plurality of cup restraining members are disposed within the recess. When cups are loaded into the tube in a direction from the dispensing end, the contact ends of the cup restraining members remain within the recess upon deflection of the cup restraining members.

DETAILED DESCRIPTION OF THE PREFERRED EMBODIMENTS

Figure 1:
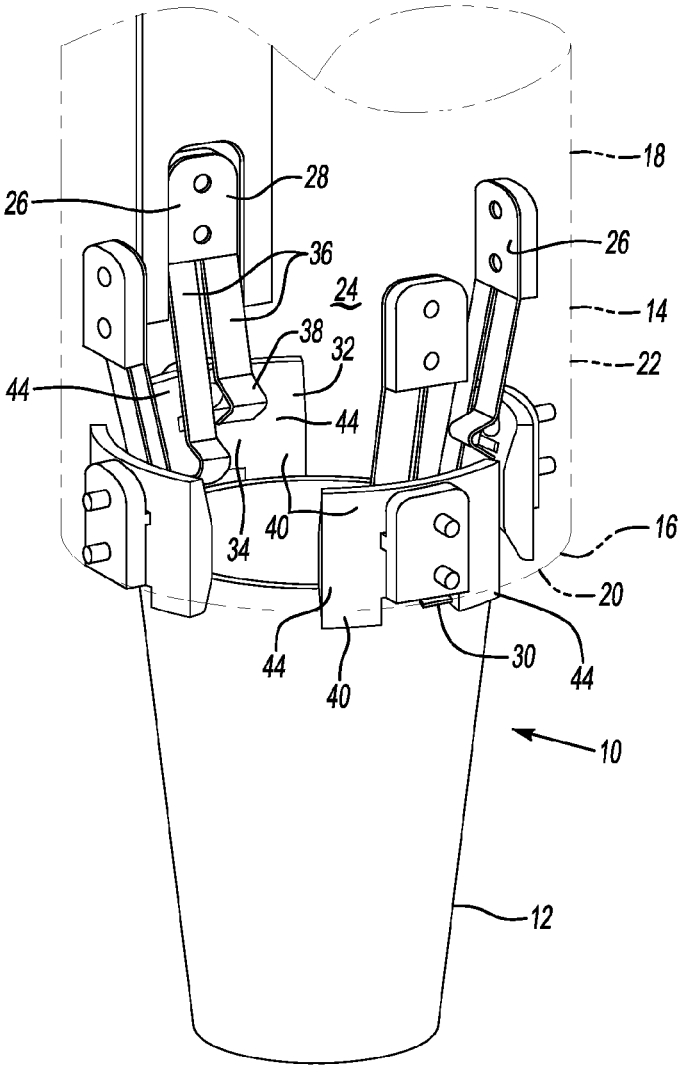
FIG. 1 is a partial perspective view of one embodiment of a cup storage device.
Figure 2:
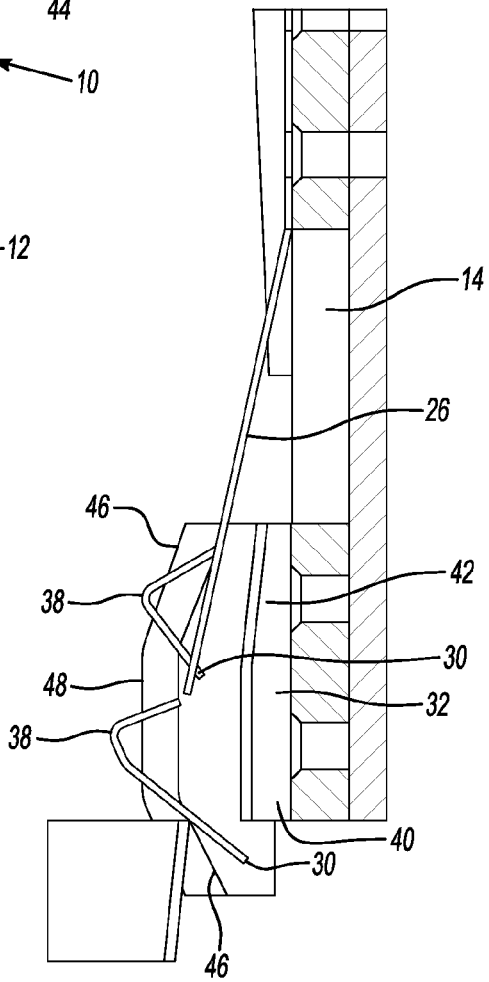
FIG. 2 is a partial sectional view detailing the plurality of resilient cup restraining members and the guide structure.
Figure 3:
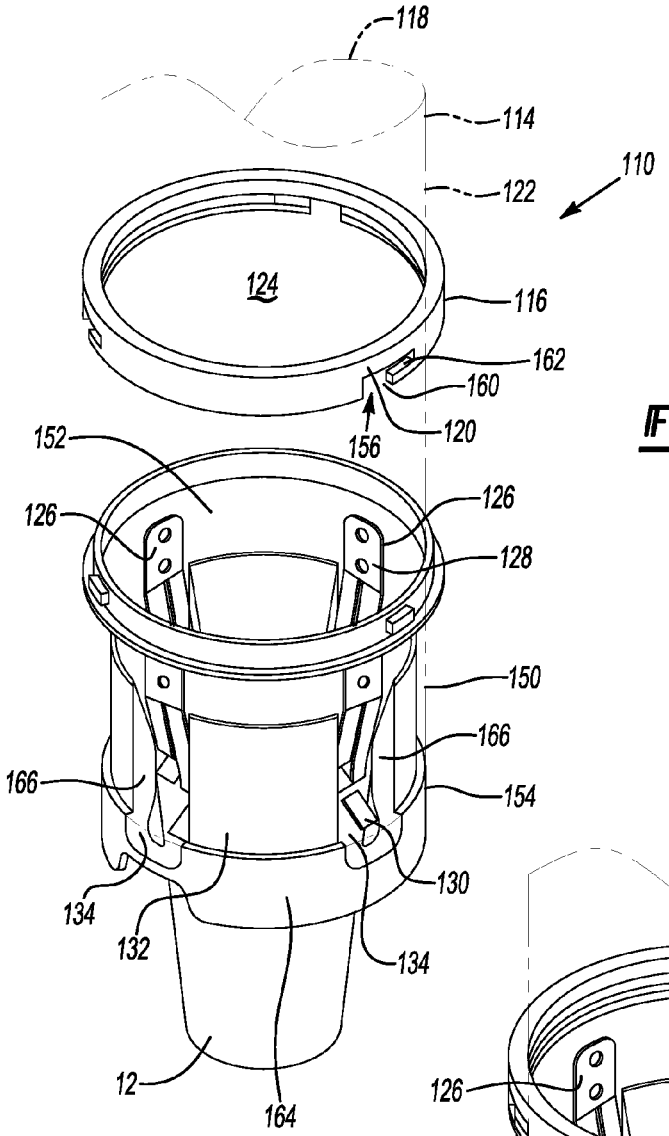
FIG. 3 is a partial perspective view of another embodiment of a cup storage device including a cup dispensing structure removably connected to the tube.
Figure 4:
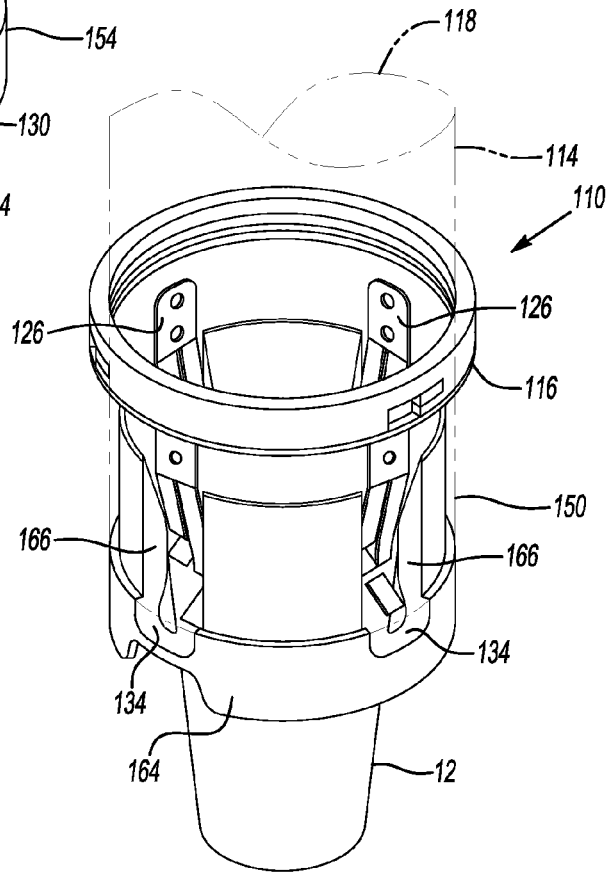
FIG. 4 is a partial perspective view of the embodiment of FIG. 2 with the cup dispensing structure connected to the tube.

Referring to FIGS. 1 and 2, there is shown an embodiment of a cup storage device 10 for storing and dispensing a plurality of cups 12. The cup storage device 10 includes a tube 14 having opposing dispensing and terminal ends 16, 18 and inner and outer surfaces 20, 22 that define an inner volume 24. The inner volume 24 receives cups 12 stacked upon each other and stores them. The cup storage device 10 includes a plurality of resilient cup restraining members 26 disposed on the inner surface 20 of the tube 14 at the dispensing end 16. The cup restraining members 26 extend from a mounting end 28 proximate the inner surface 20 of the tube to a contact end 30. A guide structure 32 is positioned on the inner surface 20 of the tube. The guide structure 32 defines a recess 34. The contact ends 30 of the plurality of cup restraining members 26 are disposed within the recess 34.

Again referring to FIGS. 1 and 2, each of the plurality of resilient cup restraining members 26 may include at least two fingers 36 extending from the cup restraining member 26. In one aspect, the at least two fingers 36 may have a differing length relative to each other. In one aspect, each of the fingers 36 extends from the mounting end 28 of the cup restraining member 26 at an angle and extends to an angled bend 38. The angled bend 38 defines a contact surface 40 for engaging a cup 12 positioned within the tube 14. The angled bend 38 may terminate at the contact end 30 which is positioned within the recess 34 of the guide structure 32.

The guide structure 32 may include various structural members to define the recess 34. In one aspect, as shown in FIG. 1, the guide structure 32 may include a plurality of guide members 40 attached to the inner surface 20 of the tube. Each of the guide members 40 includes a body 42 having opposing ramped surfaces 44 with a recess 34 defined between the ramped surfaces 44. The guide members 40 may be attached to the tube 14 utilizing fasteners or may be otherwise attached to the inner surface 20 of the tube 14 using adhesives or may be integrally formed with the inner surface 20 of the tube 14. In one aspect, the ramped surfaces 44 may include opposing angled surfaces 46 joined by a connecting surface 48 as best seen in FIG. 2.

As stated above, the contact ends 30 of the plurality of cup restraining members 26 or fingers 36 is positioned within the recess 34 of the guide member 32. In one aspect, when cups 12 are loaded into the tube 14 in a direction from the dispensing end 16, the contact ends 30 of the cup restraining members 26 remain within the recess 34 upon deflection of the resilient cup restraining members 26. In one aspect, the angled surface 46 positioned proximate the dispensing end 16 of the tube 14 defines a tapered surface 48 for aligning cups when inserted into the tube 14 from the dispensing end 16 of the tube 14. Additionally, the opposing angled surface 46 also defines a tapered surface for aligning cups 12 when inserted from the terminal end 18 of the tube 14.

Referring to FIGS. 3-6, there is shown another embodiment of a cup storage device 110 for storing and dispensing a plurality of cups 12. The depicted embodiment includes a tube 114 having opposing dispensing and terminal ends 116, 118 and inner and outer surfaces 120, 122 defining an open inner volume 24. A cup dispensing structure 150 is removably connected to the dispensing end 116 of the tube 114. The cup dispensing structure 150 includes a plurality of resilient cup restraining members 126 disposed on the inner surface 152 of the cup dispensing structure 150 at a dispensing end 154. The cup restraining members 126 extend from a mounting end 128 proximate the inner surface 152 of the cup dispensing structure 150 to a contact end 130. A guide structure 132 is positioned on the inner surface 152 of the cup dispensing structure 150. The guide structure 132 defines a recess 134. The contact ends 130 of the plurality of cup restraining members 126 are disposed within the recess 134.

In one aspect, the dispensing end 116 of the tube 114 includes at least one connection slot 156 formed thereon. The cup dispensing structure 150 includes at least one bayonet or projection 158 formed thereon that is received in the slot 156 for removably connecting the tube 114 and cup dispensing structure 150. In one aspect, the slot 156 may include an opening 160 that extends to a lateral portion 162. In this manner, the bayonet 158 may be inserted into the opening 160 followed by rotation of the cup dispensing structure 150 such that the bayonet is positioned in the lateral portion 162 to connect the cup dispensing structure 150 relative to the tube 114.

In one aspect, the guide structure of the depicted embodiment of FIGS. 3-6 includes an insert 164 mounted within the cup dispensing structure 150. It should be realized that the insert 164 depicted in FIGS. 3-6 may also be mounted within the tube 14 in place of the separate guide members 40 of the embodiments of FIGS. 1 and 2.

Figure 5:
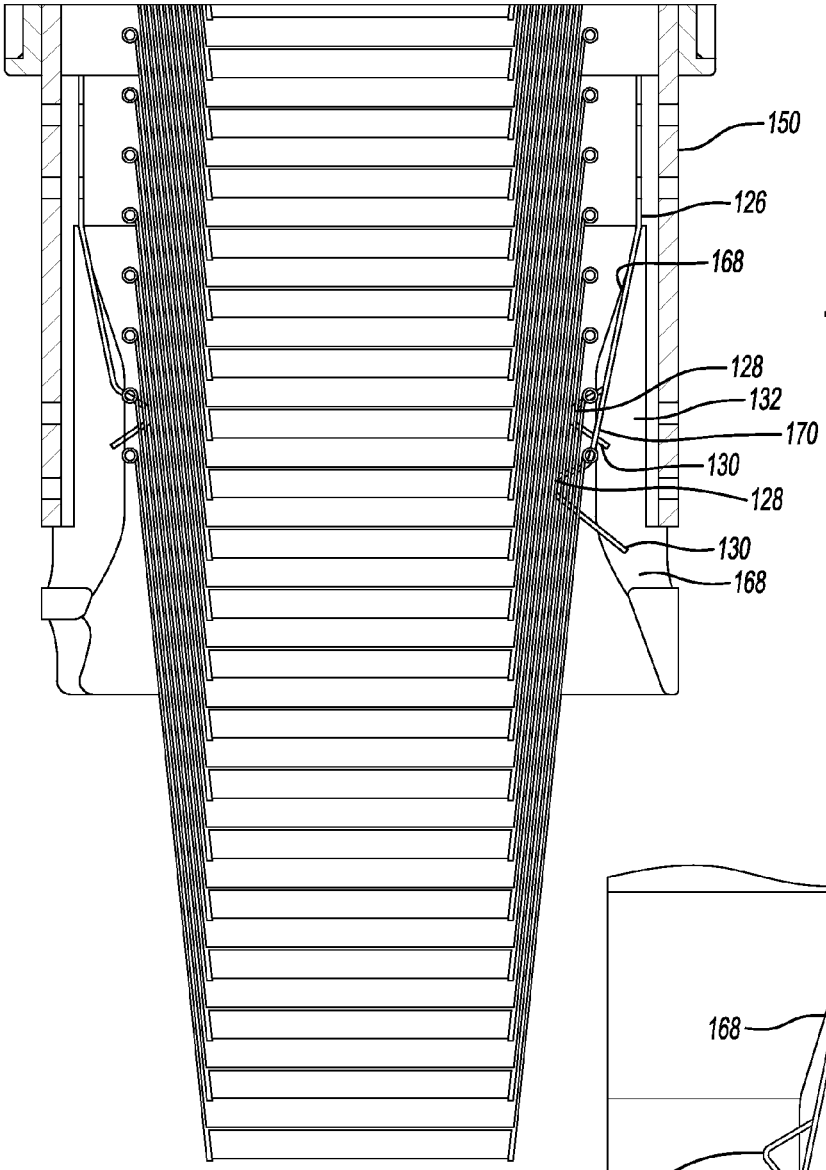
FIG. 5 is a partial sectional view of the embodiment of FIG. 3 including cups disposed within the cup storage device.
Figure 6:
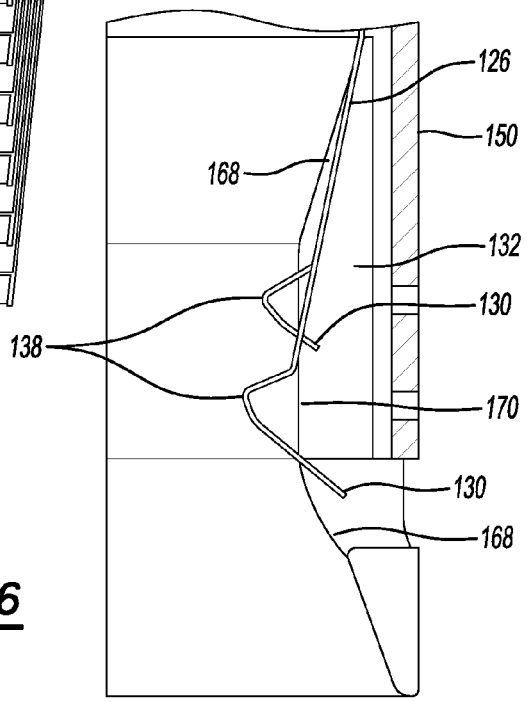
FIG. 6 is a partial sectional view detailing the plurality of resilient cup restraining members and the guide structure.

In one aspect, the guide structure 132 with the insert 164 includes spaced notches 166 formed thereon that define the recess 134. As best shown in FIGS. 5 and 6, the guide structure 132 includes ramped structures 168 and connection surfaces 170 as previously described above with respect to the guide 32 of FIGS. 1 and 2. In one aspect, the guide structure 132 may be a unitary piece that is attached to an inner surface 152 of the cup dispensing structure 150. Various fastening methods including fasteners, adhesives, or integrally forming the component with the inner surface 152 of the cup dispensing structure 150 may be utilized.

As with the previously described embodiment, the guide structure 132 may define a tapered surface at both the dispensing end and terminal ends 116, 118. Additionally as described above, each of the plurality of resilient cup restraining members 126 includes at least two fingers 136 that extend from the cup restraining member 126. Further as described above, each of the fingers 136 extends from the mounting end 128 of the cup restraining member 126 at an angle and extends to an angled bend 138. The angled bend 138 defines a contact surface for engaging a cup 12 positioned within the tube 114. Additionally, the angled bend 138 terminates at the contact end 130 with the contact end 130 positioned within the recess 134 of the guide structure 132.

Figure 7:
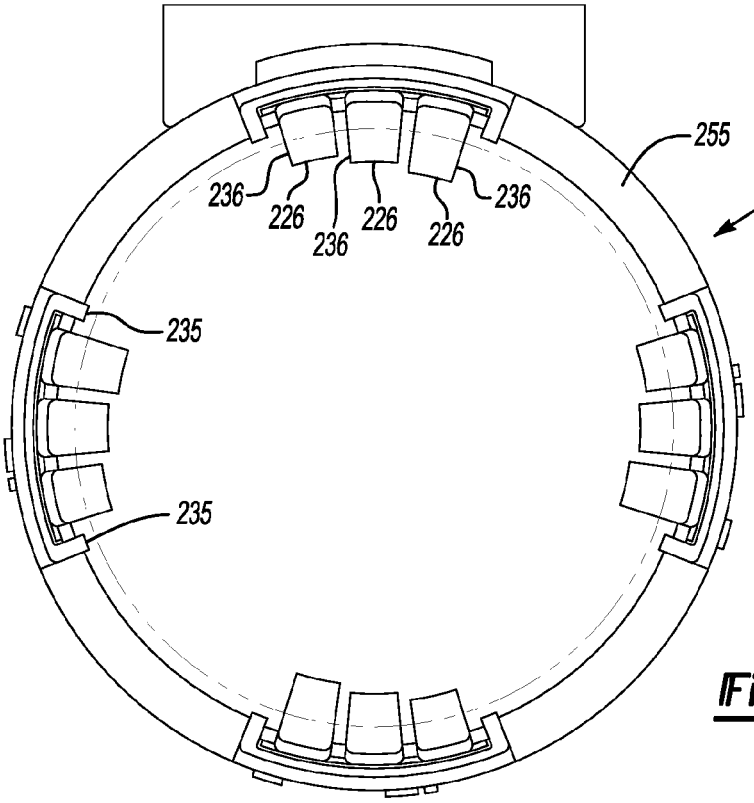
FIG. 7 is a top view of an alternative embodiment of a guide structure.
Figure 8:
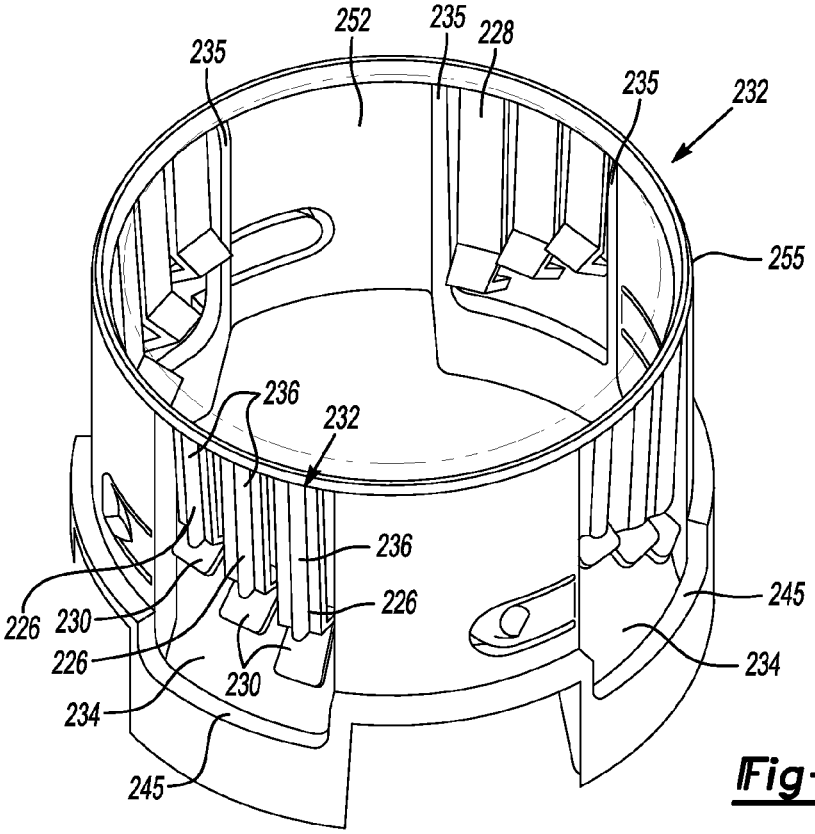
FIG. 8 is a perspective view of the alternative embodiment of the guide structure of FIG. 6.

Referring to FIGS. 7 and 8, there is shown an alternate guide structure 232 that may be positioned within the tube 14 or positioned on an inner surface 152 of the cup dispensing structure 150 described above. In the depicted embodiment of FIGS. 7 and 8, the guide structure 232 includes a plurality of spaced raised ridges 235 formed on the inner surface 252 of the guide member 232. The plurality of spaced raised ridges 235 extend toward an interior of the guide structure 232. The body 255 of the guide member 232 includes slots 245 formed therein that define that recess 234 of the guide member 232. In the depicted embodiment of FIGS. 7 and 8, the plurality of resilient cup restraining members 226 includes a plurality of fingers 236 that extend from the guide structure 232. As described above, the plurality of fingers 236 have a differing length relative to each other. In one aspect, the plurality of fingers 236 may be integrally formed with the guide member 232. Further, as described above, each of the fingers 236 extends from the mounting end 228 of the guide structure 232 at an angle and extends to an angled bend 238. The angled bend 238 defines a contact surface for engaging a cup 12 positioned within the tube 14. The angled bend 238 terminates at the contact end 230 such that the contact end 230 is positioned within the recess 234 of the guide structure 232.

Figure 9:
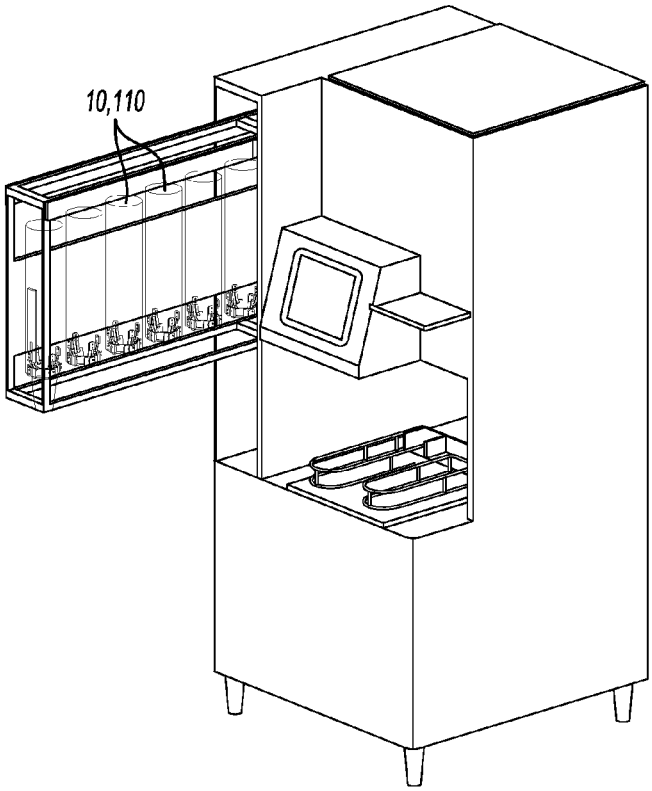
FIG. 9 is a perspective view of a beverage dispensing machine including a cup storage mechanism having the cup storage device.
Figure 10:
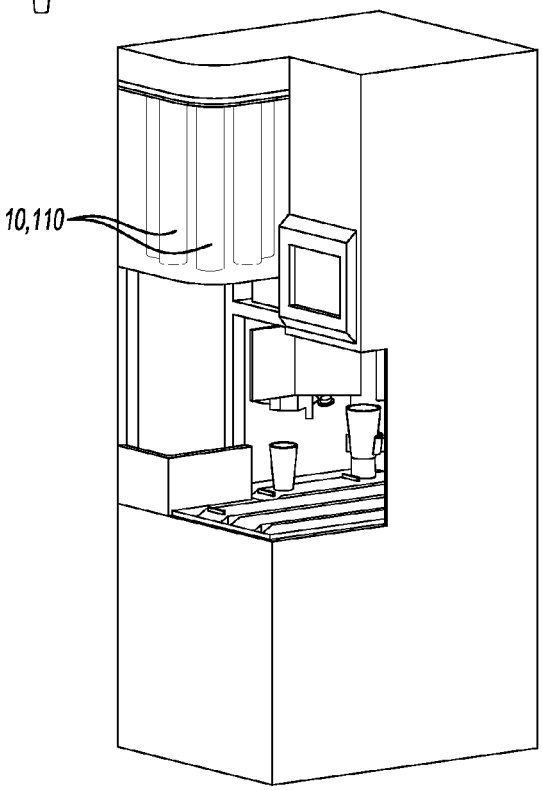
FIG. 10 is a perspective view of a beverage dispensing machine including a turret structure including the cup storage device.

The various embodiments of the cup storage device may be utilized in a beverage dispensing apparatus as shown in FIGS. 9 and 10. In the depicted embodiment of FIG. 9, the cup storage and dispensing devices 10, 110 may be positioned in a rack such that various numbers of cup storage devices 10, 110 are positioned in a vertical array. Alternatively, the cup storage devices 10, 110 may be positioned in a rotary turret as shown in FIG. 10. It should be realized that the inner diameter of the various cup storage devices 10, 110 may vary to accommodate different sized cups.

In use, a person may load cups 12 within the cup storage device 10, 110 from either the terminal end 18, 118 of the tube 14, 114 or from the dispensing end 16, 116 of the tube 14, 114. As the cups 12 are loaded into the tube 14, 114 from either end, the plurality of resilient cup restraining members 26, 126, 226 flexes to accommodate storage of cups 12 within the tube 14, 114. The contact ends 30, 130, 230 of the plurality of cup restraining members 26, 126, 226 remain disposed within the recess 34, 134, 234 as cups 12 are loaded or withdrawn from the tube 14, 114. In this manner, cups 12 may be loaded from either the terminal end 18, 118, 218 or dispensing end 16, 116, 216 of the tube 14, 114 without damage to the plurality of resilient cup restraining members 26, 126, 226.

After cups 12 have been loaded within the tube 14, 114, the angled bends 38, 138, 238 of the fingers 36, 136, 236 retain the cup stack within the tube 14, 114 to keep cups from falling through and out of the tube 14, 114. When a cup 12 is extracted from the tube 14, 114, the rim of the cup 12 will pull past the angled bend 38, 138, 238 that defines the contact surface of the finger 36, 136, 236. In one aspect, the longer of the two fingers 36, 136, 236 contacts a side surface of the cup 12 to be dispensed while the shorter contacts the rim and side surface of an adjoining cup 12 to separate cups 12 within the stack.

The invention has been described in an illustrative manner. It is to be understood that the terminology which has been used is intended to be in the nature of words of description rather than limitation. Many modifications and variations of the invention are possible in light of the above teachings. Therefore, within the scope of the appended claims, the invention may be practiced other than as specifically described.

The invention claimed is:

1. A cup storage device for storing and dispensing a plurality of cups, the cup storage device comprising:

a tube having opposing dispensing and terminal ends and inner and outer surfaces defining an open inner volume;

a cup dispensing structure removably connected to the dispensing, end of the tube, the cup dispensing structure including a plurality of resilient cup restraining members disposed on an inner surface of the cup dispensing structure at a dispensing end, the cup restraining members extending from a mounting end proximate the inner surface of the cup dispensing structure to a contact end; and a guide structure positioned on the inner surface of the cup dispensing structure, the guide structure defining a recess, the contact ends of the plurality of cup restraining members disposed within the recess;

wherein the guide structure includes a plurality of separate guide members attached to the inner surface of the cup dispensing structure.

2. The cup storage device of claim 1 wherein the dispensing end of the tube includes at least one connection slot formed thereon and the cup dispensing structure includes at least one bayonet formed thereon for removably connecting the tube and cup dispensing structure.

3. The cup storage device of claim 1 wherein the dispensing end of the tube includes at least one connection slot formed thereon and the cup dispensing structure includes at least one locking tab formed thereon for removably connecting the tube and cup dispensing structure.

4. The cup storage device of claim 1 wherein each of the plurality of resilient cup restraining members includes a plurality of fingers extending from the cup restraining member wherein the plurality of fingers have a differing length relative to each other.

5. The cup storage device of claim 1 wherein the angled bend defines a contact surface for engaging a cup positioned within the tube.

6. The cup storage device of claim 1 wherein the guide structure includes an insert mounted within the cup dispensing structure, the insert including spaced notches formed therein defining the recess.

7. The cup storage device of claim 1 wherein when cups are loaded into the tube in a direction from the dispensing end, the contact ends of the cup restraining members remain within the recess upon deflection of the cup restraining members.

8. A cup storage device for storing and dispensing a plurality of cups, the cup storage device comprising:

a tube having opposing dispensing and terminal ends and inner and outer surfaces defining an open inner volume;

a cup dispensing structure removably connected to the dispensing end of the tube, the cup dispensing structure including a plurality of resilient cup restraining members disposed on an inner surface of the cup dispensing structure at a dispensing end, the cup restraining members extending from a mounting end proximate the inner surface of the cup dispensing structure to a contact end; and a guide structure positioned on the inner surface of the cup dispensing structure, the guide structure defining a recess, the contact ends of the plurality of cup restraining members disposed within the recess;

wherein the guide structure includes a plurality of spaced raised ridges formed on the inner surface of the cup dispensing structure and extending toward an interior of the cup dispensing structure.

9. A cup storage device for storing and dispensing a plurality of cups, the cup storage device comprising:

a tube having opposing dispensing, and terminal ends and inner and outer surfaces defining an open inner volume;

a cup dispensing structure removably connected to the dispensing end of the tube, the cup dispensing structure including a plurality of resilient cup restraining members disposed on an inner surface of the cup dispensing structure at a dispensing end, the cup restraining members extending from a mounting end proximate the inner surface of the cup dispensing structure to a contact end; and a guide structure positioned on the inner surface of the cup dispensing structure, the guide structure defining a recess, the contact ends of the plurality of cup restraining members disposed within the recess;

wherein the guide structure includes a tapered surface proximate the dispensing end of the tube for aligning cups when inserted into the tube.

10. A cup storage device for storing and dispensing a plurality of cups, the cup storage device comprising:

a tube having opposing dispensing and terminal ends and inner and outer surfaces defining an open inner volume;

a cup dispensing structure removably connected to the dispensing end of the tube, the cup dispensing structure including a plurality of resilient cup restraining members disposed on an inner surface of the cup dispensing structure at a dispensing end, the cup restraining members extending from a mounting end proximate the inner surface of the cup dispensing structure to a contact end; and a guide structure positioned on the inner surface of the cup dispensing structure, the guide structure defining a recess, the contact ends of the plurality of cup restraining members disposed within the recess, wherein the cups are loaded into the tube in a direction from the dispensing end, and wherein the contact ends of the cup restraining members remain within the recess upon deflection of the cup restraining members when the cups are loaded into the tube;

wherein the guide structure includes a tapered surface proximate the dispensing end of the tube for aligning cups when inserted into the tube.

11. The cup storage device of claim 10 wherein the dispensing end of the tube includes at least one connection slot formed thereon and the cup dispensing structure includes at least one bayonet formed thereon for removably connecting the tube and cup dispensing structure.

12. The cup storage device of claim 10 wherein the dispensing end of the tube includes at least one connection slot formed thereon and the cup dispensing structure includes at least one locking tab formed thereon for removably connecting the tube and cup dispensing structure.

13. The cup storage device of claim 10 wherein each of the plurality of resilient cup restraining members includes at least two fingers extending from the cup restraining member wherein the at least two fingers have a differing length relative to each other.

14. The cup storage device of claim 10 wherein each of the plurality of resilient cup restraining members includes a plurality of fingers extending from the cup restraining member wherein the plurality of fingers have a differing length relative to each other.

15. The cup storage device of claim 10 wherein each of the fingers extends from the mounting end of the cup restraining member at an angle and extends to an angled bend that exceeds radially outwardly towards the inner surface of the tube.

16. The cup storage device of claim 15 wherein the angled bend defines a contact surface for engaging a cup positioned within the tube.

17. The cup storage device of claim 15 wherein the angled bend terminates at the contact end, the contact end positioned within the recess of the guide structure.

18. The cup storage device of claim 10 wherein the guide structure includes an insert mounted within the cup dispensing structure, the insert including spaced notches formed therein defining the recess.

19. The cup storage device of claim 10 wherein when cups are loaded into the tube in a direction from the dispensing end, the contact ends of the cup restraining members remain within the recess upon deflection of the cup restraining members.

20. A cup storage device for storing and dispensing a plurality of cups, the cup storage device comprising:

a tube having opposing dispensing and terminal ends and inner and outer surfaces defining an open inner volume;

a cup dispensing structure removably connected to the dispensing end of the tube, the cup dispensing structure including a plurality of resilient cup restraining members disposed on an inner surface of the cup dispensing structure at a dispensing end, the cup restraining members extending from a mounting end proximate the inner surface of the cup dispensing structure to a contact end; and a guide structure positioned on the inner surface of the cup dispensing structure the guide structure defining a recess, the contact ends of the plurality of cup restraining members disposed within the recess, wherein the cups are loaded into the tube in a direction from the dispensing end, and wherein the contact ends of the cup restraining members remain within the recess upon deflection of the cup restraining members when the cups are loaded into the tube;

wherein the guide structure includes a plurality of spaced raised ridges formed on the inner surface of the cup dispensing structure and extending toward an interior of the cup dispensing structure.

21. A cup storage device for storing and dispensing a plurality of cups, the cup storage device comprising:

a tube having opposing dispensing and terminal ends and inner and outer surfaces defining an open inner volume;

a cup dispensing structure removably connected to the dispensing end of the tube, the cup dispensing structure including a plurality of resilient cup restraining members disposed on an inner surface of the cup dispensing structure at a dispensing end, the cup restraining members extending from a mounting end proximate the inner surface of the cup dispensing structure to a contact end; and a guide structure positioned on the inner surface of the cup dispensing structure, the guide structure defining a recess, the contact ends of the plurality of cup restraining members disposed within the recess, wherein the cups are loaded into the tube in a direction from the dispensing end, and wherein the contact ends of the cup restraining members remain within the recess upon deflection of the cup restraining members when the cups are loaded into the tube;

wherein the guide structure includes a plurality of separate guide members attached to the inner surface of the cup dispensing structure.

* * * * *